US005736994A

United States Patent [19]

Takahashi

[11] Patent Number: 5,736,994

[45] Date of Patent: Apr. 7, 1998

[54] INK-JET APPARATUS AND DRIVING METHOD THEREOF

[75] Inventor: Yoshikazu Takahashi, Nagoya, Japan

[73] Assignee: Brother Kogyo Kabushiki Kaisha, Nagoya, Japan

[21] Appl. No.: 664,430

[22] Filed: Jun. 18, 1996

[30] Foreign Application Priority Data

Aug. 9, 1995 [JP] Japan ..... 7-203175

[51] Int. Cl.[6] ..... B41J 2/01

[52] U.S. Cl. ..... 347/11; 347/14

[58] Field of Search ..... 347/10, 9, 14, 347/11

[56] References Cited

U.S. PATENT DOCUMENTS

| | | | |
|---|---|---|---|
| 3,946,398 | 3/1976 | Kyser et al. | 346/75 |
| 4,087,825 | 5/1978 | Chen et al. | 346/75 |
| 4,686,539 | 8/1987 | Schmidle et al. | 347/11 |
| 4,845,514 | 7/1989 | Mitsushima et al. | 346/76 PM |
| 4,879,568 | 11/1989 | Bartky et al. | 346/140 R |
| 5,036,337 | 7/1991 | Rezanka | 346/1.1 |
| 5,204,695 | 4/1993 | Tokunaga et al. | 347/11 |
| 5,300,968 | 4/1994 | Hawkins | 346/140 R |
| 5,331,340 | 7/1994 | Sukigara | 347/14 |
| 5,576,743 | 11/1996 | Momose et al. | 347/11 |

*Primary Examiner*—Edgar S. Burr
*Assistant Examiner*—Steven S. Kelley
*Attorney, Agent, or Firm*—Oliff & Berridge, PLC

[57] ABSTRACT

A first pulse signal A of a first drive waveform used when an ambient temperature is 25° C. or less has a peak value of 22 (V). The pulse width WA of the first pulse signal A matches with time T during which a pressure wave uni-directionally travels along the inside of an ink flow passage. A second drive waveform used when the ambient temperature is in excess of 25° C. includes a second pulse signal B used for ejecting ink and a third pulse signal C used for compensating for variations in a residual pressure within the ink flow passage occurs after the ink has been ejected. Both the second pulse signal B and the third pulse signal C have a peak value of 22 (V). The pulse width WB of the second pulse signal B is 0.7 times the uni-directional propagation time T, whereas the pulse width WC of the third pulse signal C is half the uni-directional propagation time T. A delay time D between center time T1M of the second pulse signal B and center time T2M of the third pulse signal C is 3.0 times the uni-directional propagation time T. As a result, it is possible to implement an inexpensive ink-jet apparatus and a driving method thereof which prevent variations in an ink jet velocity caused by variations in ambient temperature, and which provide superior print quality.

20 Claims, 11 Drawing Sheets

Fig.11

| WC(xT) \ D(xT) | 2.5 | 2.75 | 3.0 | 3.25 | 3.5 |
|---|---|---|---|---|---|
| 0.3 | × | ○ | ○ | ○ | × |
| 0.5 | △ | ○ | ◎ | ○ | △ |
| 0.7 | × | ○ | ○ | ○ | × |
| 1.0 | × | △ | ○ | △ | × |
| 1.3 | △ | ○ | ◎ | ○ | △ |
| 1.5 | △ | ○ | ◎ | ○ | △ |
| 1.7 | △ | ○ | ◎ | ○ | △ |
| 2.0 | × | △ | ○ | △ | × |

◎ VARIATION OF VELOCITY : LESS THAN 1.0 m/s
○ VARIATION OF VELOCITY : 1.0~2.0 m/s
△ VARIATION OF VELOCITY : 2.0~3.0 m/s
× JETTING IS DISABLED

INK-JET APPARATUS AND DRIVING METHOD THEREOF

BACKGROUND OF THE INVENTION

1. Field of the Invention

The invention relates to an ink-jet apparatus and a driving method thereof.

2. Description of Related Art

Non-impact printers are currently expanding their markets, taking the place of impact printers already on the market. Of the various types of non-impact printers, an ink-jet printer is based on the simplest principle and can easily implement multiple gradations and color printing. Among the ink-jet printers, a drop-on-demand ink-jet printer, which ejects only ink droplets to be used in printing, is rapidly coming into wide use because of its superior spraying efficiency and inexpensive running cost.

A Kyser ink-jet printer disclosed in U.S. Pat. No. 3,946,398 and a thermal-jet printer disclosed in Japanese unexamined Patent Publication No. 55-27282 are known as representative drop-on-demand type ink-jet printers. It is difficult to reduce the size of the former printer, and the ink used in the latter printer is required to be heat resistant because the ink is subjected to a high temperature. For these reasons, each of the printers has its own very difficult problem.

A shear mode jet-printer as disclosed in U.S. Pat. No. 4,879,568 that utilizes the piezoelectric deformation of ceramics in a shear mode is proposed as a new method for solving the problems of the prior art.

As shown in FIGS. 1 and 2, a shear mode ink-jet apparatus 600 comprises a bottom wall 601, a top wall 602, and shear mode actuator walls 603. Each actuator wall 603 is composed of a lower wall 607 which is bonded to the bottom wall 601 and is polarized in the direction designated by an arrow 611, and an upper wall 605 which is bonded to a top wall 602 and is polarized in the direction of an arrow 609. Each pair of actuator walls 603 constitutes an ink flow passage 613 between the upper and lower walls. A space 615 which is narrower than the ink flow passage 613 is formed between each adjacent pair of actuator walls 603.

A nozzle plate 617 having a nozzle 618 formed therein is fixedly provided at one longitudinal end of each ink flow passage 613. An electrode 619 is provided on one side of the actuator wall 603 in the form of a metal layer, and another electrode 621 is provided on the other side of the actuator wall 603, also in the form of a metal layer. Specifically, the actuator wall 603 of the ink flow passage 613 is provided with the electrode 619, and the actuator wall 603 of the space 615 is provided with the electrode 621. The surface of the electrode 619 is coated with an insulating layer 630 so as to isolate the electrode surface from ink. The electrode 621 is provided so as to face the space 615 and is grounded to an earth ground 623. The electrode 619 provided in the ink flow passage 613 is connected to a drive control circuit 625 which outputs an actuator drive signal.

The manufacture of the ink-jet apparatus 600 will now be described. A piezoelectric ceramics layer polarized in the direction designated by the arrow 611 is bonded to the bottom wall 601, and a piezoelectric ceramic layer polarized in the direction designated by the arrow 609 is bonded to the top wall 602. The thickness of the respective ceramics layers is substantially equal to the height of the lower wall 607 and the upper wall 605. Parallel notches are then cut in the piezoelectric ceramics layers by means of the rotation of a diamond cutting disk, whereby the lower wall 607 and the upper wall 605 are formed. The electrodes 619 and 621 are deposited on the side surface of the lower wall 607 by vapor deposition, and the electrode 619 is further coated with the insulating layer 630. Similarly, the electrodes 619 and 621 are formed on the side surface of the upper wall 605, and the electrode 619 is further coated with the insulating layer 630.

The peaks between the notches of the upper wall 605 and the lower wall 607 are bonded together, so that the ink flow passages 613 and the spaces 615 are formed. The nozzle plate 617 having the nozzle 618 formed therein is bonded to the respective longitudinal ends of the ink flow passage 613 and the space 615 in such a way that the nozzle 618 corresponds to the ink flow passage 613. The other longitudinal ends of the ink flow passage 613 and the space 615 are electrically connected to the control circuit 625 and the earth ground 623.

As a result of the application of a voltage from the control circuit 625 to the electrode 619 of each ink flow passage 613, the actuator wall 603 causes piezoelectric thickness deformation in such a direction that the volume of the ink flow passage 613 increases.

For example, FIG. 3 shows one example of the piezoelectric thickness deformation. If a predetermined voltage E (V) is applied to an electrode 619C of an ink flow passage 613C, an electric field develops in an actuator wall 603E in the directions designated by arrows 629 and 631, and an electric field develops in an actuator wall 603F in the directions designated by arrows 633 and 632. As a result, the actuator walls 603E and 603F cause piezoelectric thickness deformation in such a direction that the volume of the ink flow passage 613C increases. At this time, a pressure within the ink flow passage 613C including the vicinity of a nozzle 618C decreases. The pressure is held in a decreased state for time T during which a pressure wave longitudinally and uni-directionally travels along the inside of the ink flow passage 613. During this period, ink is fed from a common ink chamber 626 to the ink flow passage.

The time T is necessary for the pressure wave to travel along the ink flow passage 613 in a longitudinal direction thereof. The uni-directional propagation time T is determined by the length L of the ink flow passage 613 and the speed of sound "a" in the ink within the ink flow passage 613. Specifically, the uni-directional propagation time T is defined as $T=L/a$.

According to the theory of propagation of pressure waves, the pressure within the ink flow passage 613 is reversed immediately after precisely the time T has elapsed since the application of the pressure, whereupon the pressure changes so as to become positive. The voltage applied to an electrode 619C of the ink flow passage 613C is reset to 0 (V) in accordance with the inversion of the pressure from negative to positive. As a result, the actuator walls 603E and 603F return to their original states as shown in FIG. 1, and the ink is pressurized. At this time, the pressure that became positive, and the pressure developed as a result of the actuator walls 603E and 603F returning to the original states, are added to each other, so that a relatively high pressure develops in the vicinity of the nozzle 618C of the ink flow passage 613C. Eventually, the ink is ejected from the nozzle 618C.

However, the viscosity of the ink used in this type of ink-jet apparatus changes depending on ambient temperature. For example, a viscosity of about 3 mPa·s at a temperature of 25° C. changes to about 6 mPa·s at a temperature of 10° C. and to about 2 mPa·s at a temperature of 40° C. If the viscosity of the ink changes, an ink droplet jet velocity will change. As a result, the ink droplet may arrive at a position that is not an expected location on the recording medium when temperature varies from normal, thereby resulting in print quality being deteriorated.

To solve such a problem, the ink droplet jet velocity is conventionally controlled by changing a drive voltage of the ink-jet apparatus corresponding to variations in ambient temperature of the ink-jet apparatus. However, it is necessary to provide a drive circuit with a voltage variable circuit, thereby increasing the cost of the drive circuit.

Further, if the viscosity of the ink changes as a result of variations in the ambient temperature, the vibration of the residual pressure within the ink flow passage occurring after the ink has been ejected will also change, as well as the droplet jet speed changing. Therefore, the ink droplet jet velocity changes, which in turn results in poor print quality.

SUMMARY OF THE INVENTION

An object of the invention is to provide an inexpensive ink-jet apparatus and a driving method thereof which prevent variations in an ink droplet jet velocity caused by variations in ambient temperature by means of only a single drive voltage, and which provides superior print quality.

To this end, according to one aspect of the invention, there is provided a method of driving an ink-jet apparatus comprising an ink chamber filled with ink, an actuator for changing the volume of the ink chamber, and a control unit which causes a pressure wave to develop in the ink chamber by applying a first pulse signal to the actuator so as to increase the volume of the ink chamber, and which causes the volume of the ink chamber to be decreased from the increased state to the original state after a lapse of time T during which the pressure wave uni-directionally travels along the inside of the ink chamber, so that the ink in the ink chamber is pressurized and eventually ejected, the control unit applying the first pulse signal to the actuator if an ambient temperature is at a predetermined temperature or less. As a result, the ink is ejected, and printing is implemented. On the other hand, if the ambient temperature is in excess of the predetermined temperature, the control unit applies a second pulse signal, which has a different pulse width but the same peak value compared with the first pulse signal, to the actuator so as to cause the ink to be ejected. Thereafter, the control unit applies a third pulse signal, which has a pulse width 0.3 to 0.7 times or 1.3 to 1.7 times the uni-directional propagation time T but the same peak value as the second pulse signal, to the actuator. At this time, the control unit controls timings at which the pulse signals are applied in such a way that center time T2M between time T2S at which the third pulse signal rises and time T2E at which the third pulse signal falls becomes 2.75 to 3.25 times the uni-directional propagation time T with regard to center time T1M between time T1S at which the second pulse signal rises and time T1E at which the second pulse signal falls. By virtue of this control, variations in the ink jet velocity caused as a result of changes in the ambient temperature are prevented.

The third pulse signal is intended to cancel variations in a residual pressure. Specifically, the application of the third pulse signal is intended to prevent the ink droplet jet velocity from being affected by variations in the residual pressure when the viscosity of the ink drops as a result of a rise in the ambient temperature.

By virtue of the ink-jet apparatus and the driving method thereof according to the invention, the pulse width of the third pulse signal is set to be 0.5 times or 1.3 to 1.7 times the uni-directional propagation time T, and the control unit applies the third pulse signal to the actuator in such a way that the center time T2M of the third pulse signal becomes 3.0 times the uni-directional propagation time T with respect to the center time T1M of the second pulse signal. As a result, variations in the ink jet velocity are prevented.

Further, by virtue of the ink-jet apparatus and the driving method thereof according to the invention, the pulse width of the second pulse signal is 0.5 to 0.9 times or 1.1 to 1.6 times the uni-directional propagation time T. Therefore, in the event the ambient temperature is in excess of the predetermined temperature, it is possible to eject the ink at the same jet velocity when the ink is ejected at the ambient temperature of the predetermined temperature or less.

According to the ink-jet apparatus and the driving method thereof of the invention, the actuator acts as at least some of the wall forming the ink chamber, and at least a part of the wall is made of a piezoelectric material. The control unit causes the ink to be ejected by applying any one of the first, second, and third pulse signals to the actuator in order to change the volume of the ink chamber.

As previously mentioned, by virtue of the ink-jet apparatus and the driving method thereof according to the invention, when the ambient temperature is at the predetermined temperature or less, the control unit applies the first pulse signal to the actuator so as to cause the ink to be ejected, whereby printing is implemented. In the event the ambient temperature is in excess of the predetermined temperature, the control unit applies the second and third pulse signals to the actuator so as to cause the ink to be ejected, whereby printing is carried out. As a consequence, it is possible to prevent variations in the ink jet velocity even if the ambient temperature changes. For these reasons, it is possible to carry out high-grade printing irrespective of the ambient temperature. Moreover, the ink-jet apparatus can be driven by use of a single drive source, which in turn renders a drive circuit simpler than the conventional drive circuit. Therefore, the cost of the ink-jet apparatus can be reduced.

By virtue of the ink-jet apparatus and the driving method thereof according to the invention, the pulse width of the third pulse signal is set to be 0.5 times or 1.3 to 1.7 times the uni-directional propagation time T, and the control unit applies the third pulse signal to the actuator in such a way that the center time T2M of the third pulse signal becomes 3.0 times the uni-directional propagation time T with respect to the center time T1M of the second pulse signal. As a result, it is possible to reduce variations in the ink jet velocity and to implement higher-grade printing.

Further, by virtue of the ink-jet apparatus and the driving method thereof according to the invention, the pulse width of the second pulse signal is 0.5 to 0.9 times or 1.1 to 1.6 times the uni-directional propagation time T. As a consequence, the ink jet velocity remains stable, and the ink can be ejected in a superior manner in the event the ambient temperature is in excess of a predetermined temperature.

According to the ink-jet apparatus and the driving method thereof of the invention, the actuator acts as at least some of the wall forming the ink chamber, and at least a part of the wall is made of a piezoelectric material. The control unit causes the ink to be ejected by applying any one of the first, second, and third pulse signals to the actuator. As a result, it is possible to cause the ink to be ejected as well as to change the volume of the ink chamber in a superior manner irrespective of the ambient temperature.

BRIEF DESCRIPTION OF THE DRAWINGS

Preferred embodiments of the invention will be described in detail with reference to the following drawings wherein:

FIG. 11 is a table showing variations in an ink-jet velocity obtained when a pulse width of a second pulse signal and a second pulse signal application timing employed in the ink-jet apparatus and the driving method thereof were changed.

DETAILED DESCRIPTION OF THE PREFERRED EMBODIMENTS

With reference to the accompanying drawings, one exemplification which embodies the invention will be described hereinbelow.

Figure 1:
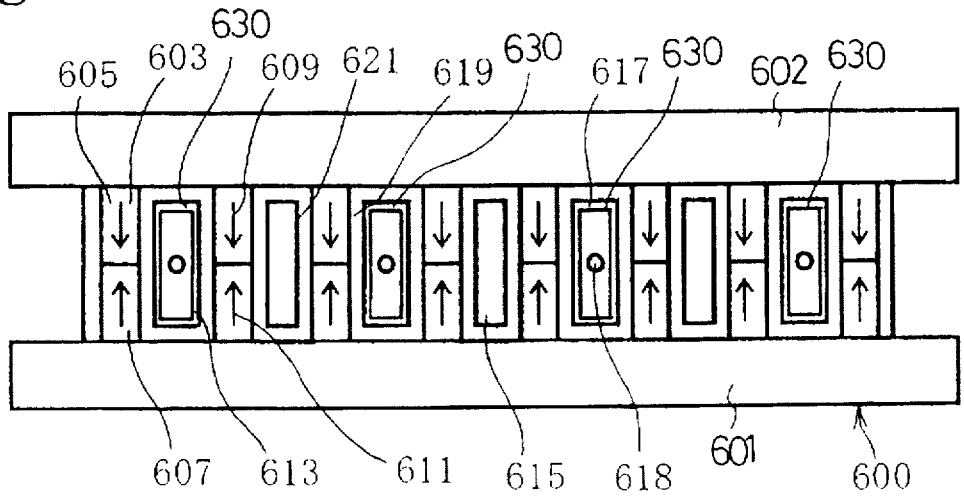
Fig.1 RELATED ART
FIG. 1 is a front view showing the construction of a conventional ink-jet apparatus.
Figure 2:
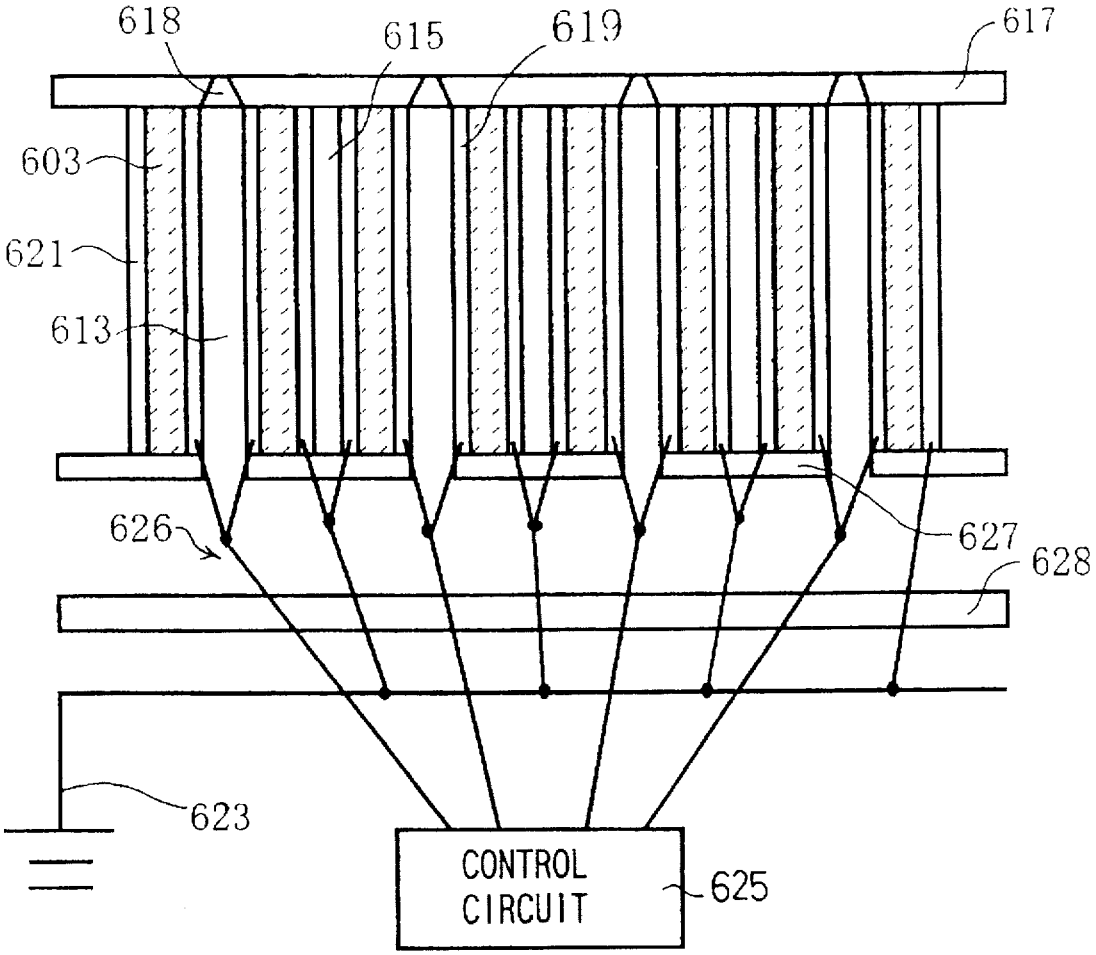
Fig.2 RELATED ART
FIG. 2 is a plan view showing the configuration of a conventional ink-jet apparatus.

As with the conventional ink-jet apparatus 600 shown in FIGS. 1 and 2, the ink-jet apparatus 600 of the invention is made up of a bottom wall 601, a top wall 602, and actuator walls 603 which are sandwiched between the bottom and top walls and experiences shear mode deformation. Each actuator wall 603 is further made up of a lower wall 607 which is bonded to the bottom wall 601 and is polarized in the direction designated by an arrow 611, and an upper wall 605 which is bonded to the top wall 602 and is polarized in the direction designated by an arrow 609. A pair of actuator wall pieces 603 form an ink flow passage 613, and a space 615 which is narrower than the ink flow passage 613 is formed between each adjacent pair of actuator walls 603.

A nozzle plate 617 having a nozzle 618 formed therein is fixedly attached to one longitudinal end of each ink flow passage 613. An electrode 619 is formed in the form of a metal layer on one side of the actuator wall 603, and an electrode 621 is formed, also in the form of a metal layer, on the other side of the actuator wall 603. Specifically, a common ink chamber 626 is disposed on the other longitudinal end of each ink flow passage 613, and, further, a manifold member 628 having a sealing section 627 to prevent ink in the common ink chamber 626 from leaking into the space 615 is fixedly attached to the other longitudinal end of each ink flow passage 613.

The electrode 619 is covered with an insulating layer 630 for insulating the electrode 619 from the ink. The electrode 621 is provided so as to face the space 615 and is connected to an earth ground 623. The electrode 619 is provided within the ink flow passage 613 and is connected to a control circuit 625 which outputs an actuator drive signal.

Figure 4:
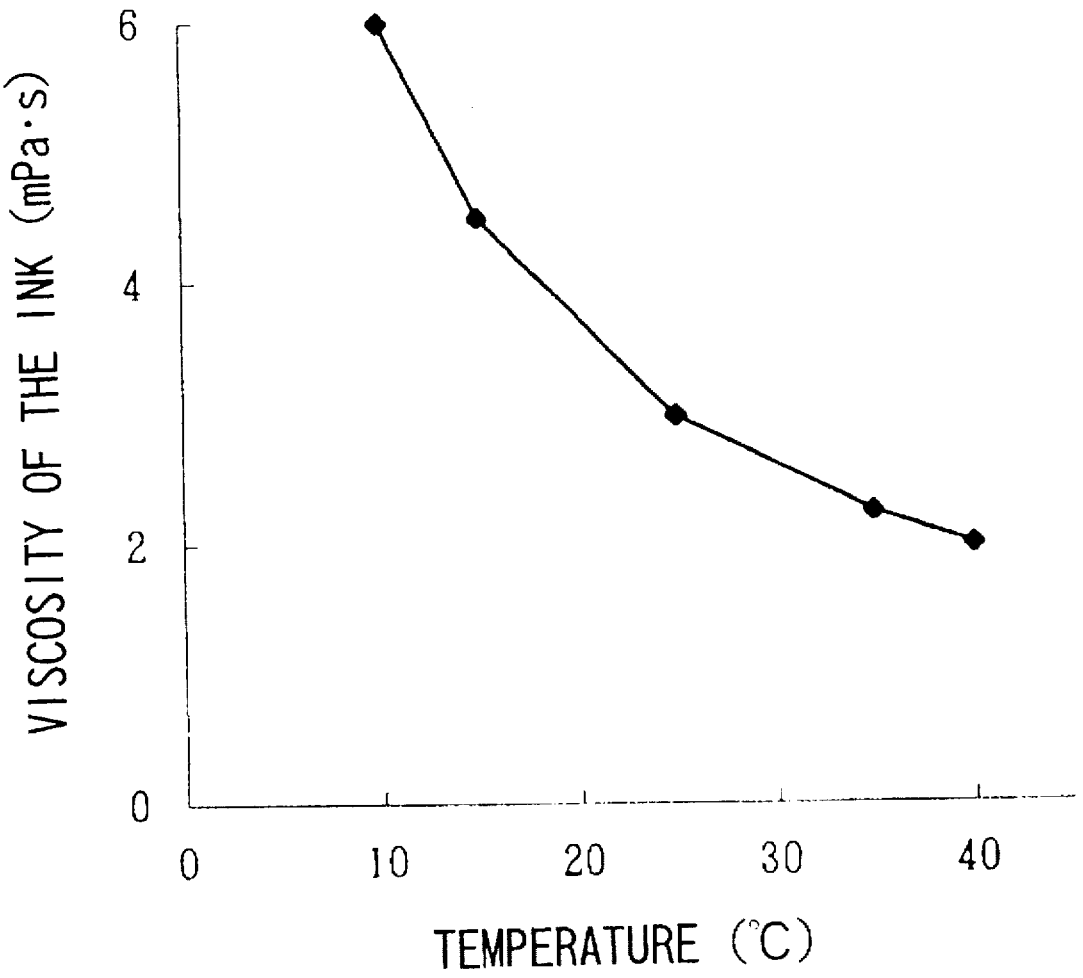
FIG. 4 is a plot showing variations in the viscosity of ink vs. variations in temperature according to the invention.

One specific example of the size of the ink-jet apparatus 600 of the invention will now be described. The length L of the ink flow passage 613 may be 7.5 mm. The diameter of the part of the nozzle 618 close to the ink jet nozzle may be 35 μm, whereas the diameter of the nozzle 613 close to the ink flow passage may be 72 μm. The length of the ink jet apparatus may be 100 μm. The ink used in the test has a viscosity of 3 mPa·s and a surface tension of 30 mN/m at a temperature of 25° C. As shown in FIG. 4, the viscosity of the ink is 6 mPa·s at a temperature of 10° C. and 2 mPa·s at a temperature of 40° C. A ratio of the speed of sound "a" in the ink within the ink flow passage 613 to the length L of the ink flow passage 613, that is, L/a (=time T during which a pressure wave uni-directionally travels through the ink flow passage), is 12 μsec.

Figure 5:
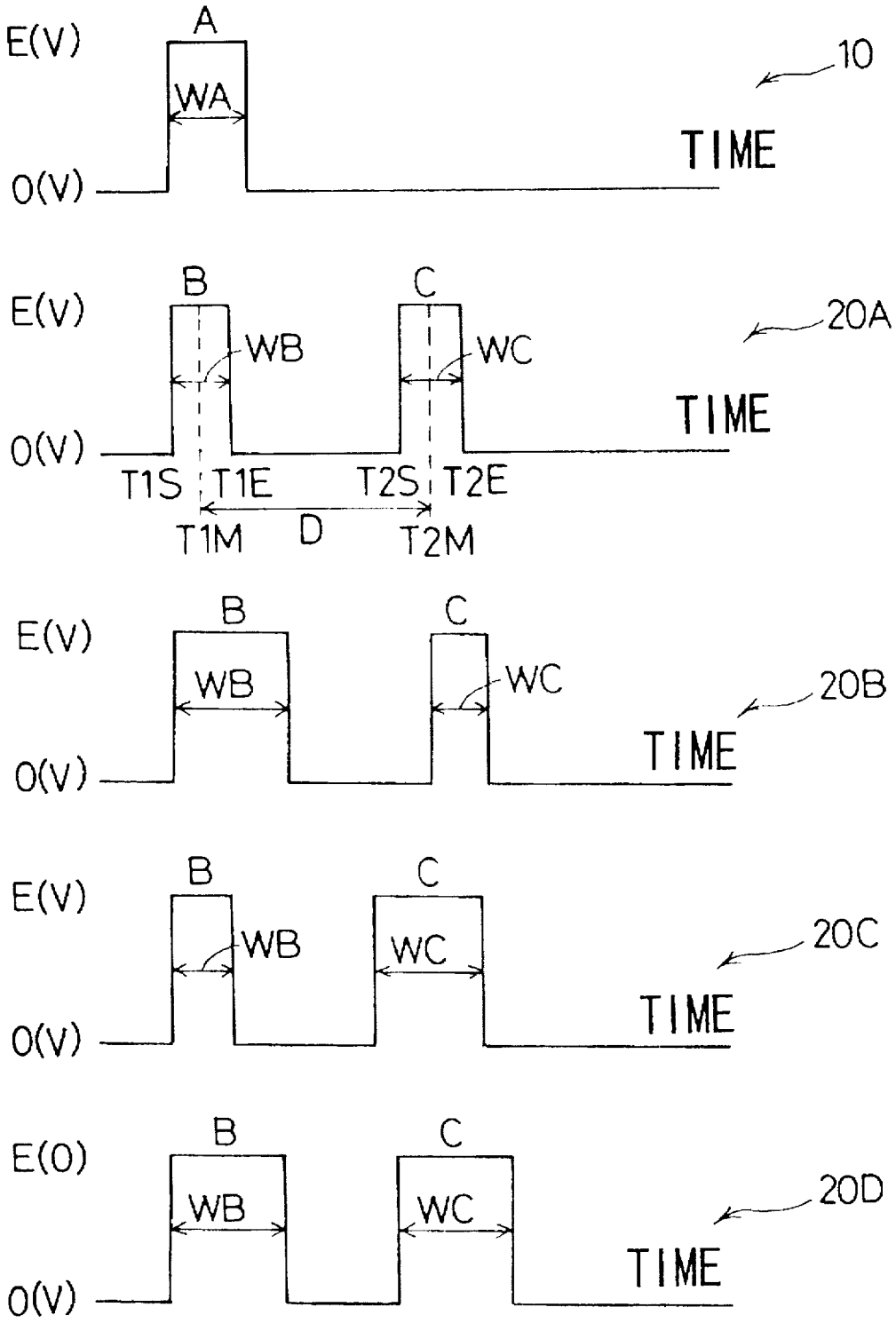
FIG. 5 is a timing chart showing drive waveforms of the ink-jet apparatus according to one embodiment of the invention.

FIG. 5 shows drive waveforms 10 and 20A to 20D applied to the electrode 619 within the ink flow passage 613. A first drive waveform 10 is used for increasing the speed at which ink having a high viscosity is ejected. Second waveforms 20A to 20D are used for decreasing the speed at which ink having a low viscosity is ejected and for reducing variations in the ink jet velocity with respect to variations in temperature and frequency. For example, the drive waveform 10 is used for driving the ink-jet apparatus at a temperature of 25° C. or less, and one of the drive waveforms 20A to 20D are used at a temperature of 25° C. or more. As a consequence, it is possible to reduce variations in the ink jet velocity caused by variations in an ambient temperature.

The first drive waveform 10 is composed of only a jet pulse signal A for ejecting the ink. The jet pulse signal A has a peak value (a voltage) E (V) (e.g., 22 (V)). A pulse width WA of the jet pulse signal A is identical with time T (L/a) during which a pressure wave uni-directionally travels along the inside of the ink flow passage 613, that is, 12 μsec.

The second drive waveforms 20A and 20B are composed of a second pulse signal B for ejecting the ink and a third pulse signal C for canceling variations in a residual pressure within the ink flow passage 613 occurring after the ink has been ejected. Both the second and third pulse signals B and C have the same peak value (a voltage) (e.g., 22 V)). A pulse width WB of the second pulse signal B of the second drive waveform 20A is 0.7 times the uni-directional propagation time T of the pressure wave within the ink flow passage 613, that is, 8.4 μsec. A pulse width WC of the third pulse signal C is 0.5 times the uni-directional propagation time T of the pressure wave within the ink flow passage 613, that is, 6 μsec. As a result of the pulse width WB of the second pulse signal B being set to 0.7 T, the ink is ejected at a lower speed than it is ejected by means of the first drive waveform 10, provided that the ink has the same viscosity. In other words, if the ink has a high viscosity at a temperature of 25° C. or less, the ink jet velocity obtained by use of the first drive waveform will be decreased compared to when the ink jet velocity obtained when the ink has a lower viscosity. For this reason, if the ink has a low viscosity at a temperature of more than 25° C., the use of the second pulse signal makes it possible to obtain the same ink jet velocity as it is obtained when the ink has a high viscosity. As a consequence, it is possible to prevent letters from being printed at an unexpected position. The ink jet velocity becomes maximum when the pulse width WB of the pulse signal becomes 1T.

Accordingly, as with the drive waveforms 20A and 20C shown in FIG. 5, the pulse width WB of the second pulse signal B is set so as to become 0.5 to 0.9 times the uni-directional propagation time T of the pressure wave in association with changes in the type of the ink, the shape of the ink flow passage, and the shape of the nozzle. Further, as with the drive waveforms 20B and 20D shown in FIG. 5, the pulse width is changed to become 1.1 to 1.6 times the uni-directional propagation time T of the pressure wave, whereby the first drive waveform 10 and the ink droplet jet velocity are controlled.

A delay time D from center time T1M between time T1S at which the second pulse signal B rises and time T1E at which the second pulse signal B drops to center time T2M between time T2S at which the third pulse signal C rises and time T2E at which the third pulse signal C falls is 3.0 times the time T during which the pressure wave uni-directionally travels along the inside of the ink flow passage 613, that is, 36 μsec. On the assumption that the delay time D is 3 T, the effect of canceling variations in the residual pressure becomes maximum. However, it is possible to sufficiently cancel the variations in the residual pressure so long as the delay time D is set to the range from 2.75 T to 3.25 T.

The pulse width WC of the third pulse signal C may be set to 0.5 T (6 μsec.) in the same manner as the drive waveforms 20A and 20B shown in FIG. 5, or may be set to 1.3 T to 1.7 T in the same manner as the drive waveforms 20C and 20D. These values are quoted from results of a test shown in FIG. 11, and they are selected because variations in the ink jet velocity obtained at these values are designated by a double circle, that is, under 1.0 m/s.

Figure 6:
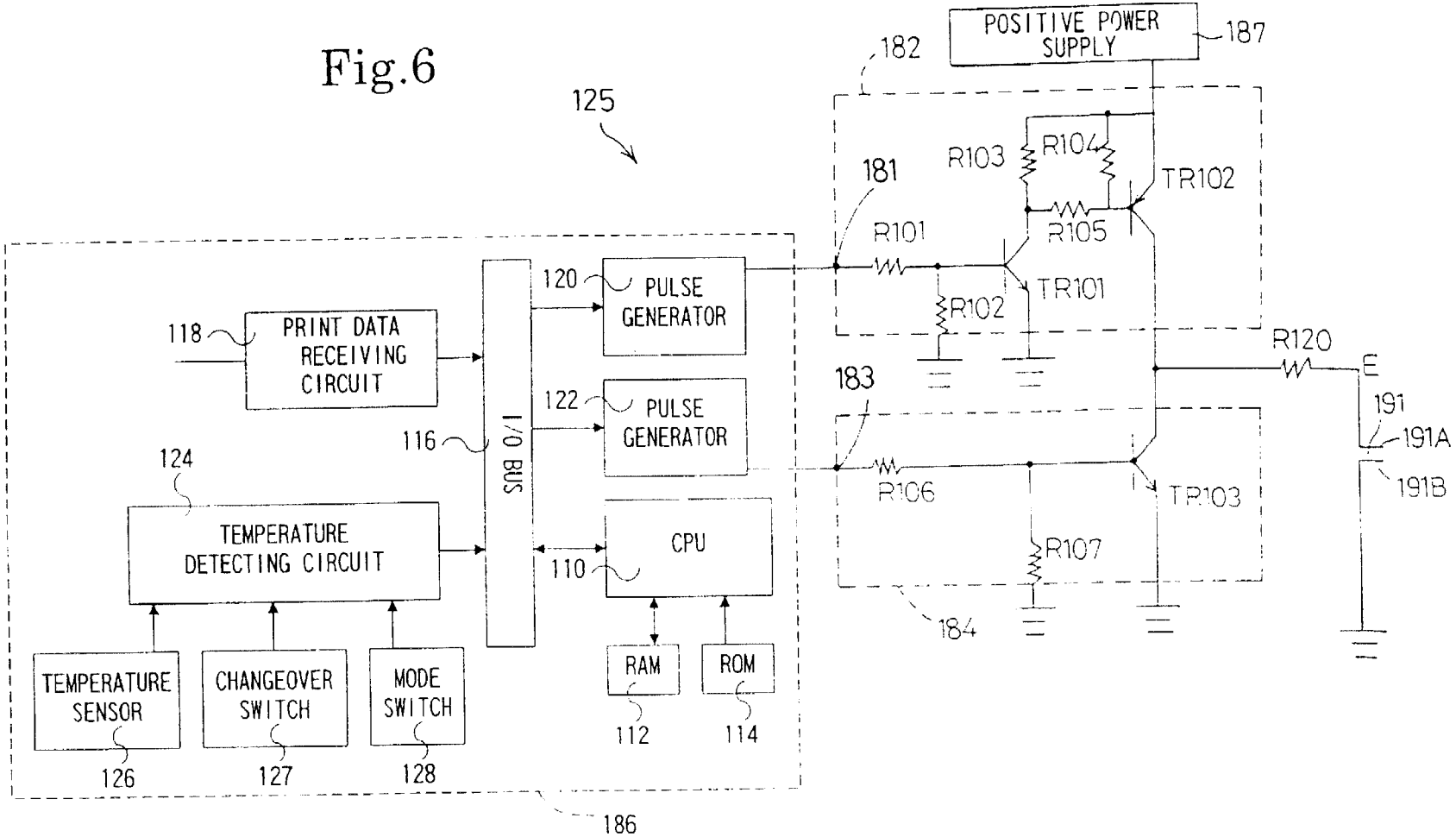
FIG. 6 is a circuit diagram showing the configuration of a control circuit according to an embodiment of the invention.
Figure 7:
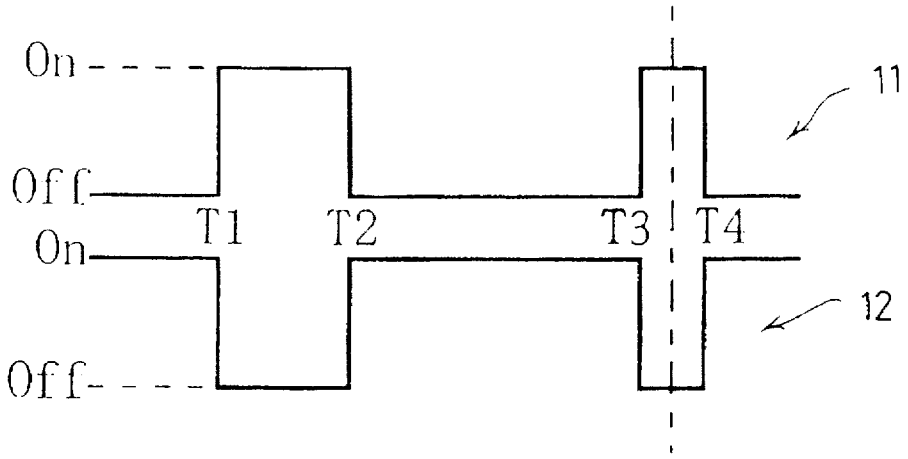
FIGS. 7A and 7B are timing charts of drive pulses used in an embodiment of the invention.
Figure 7:
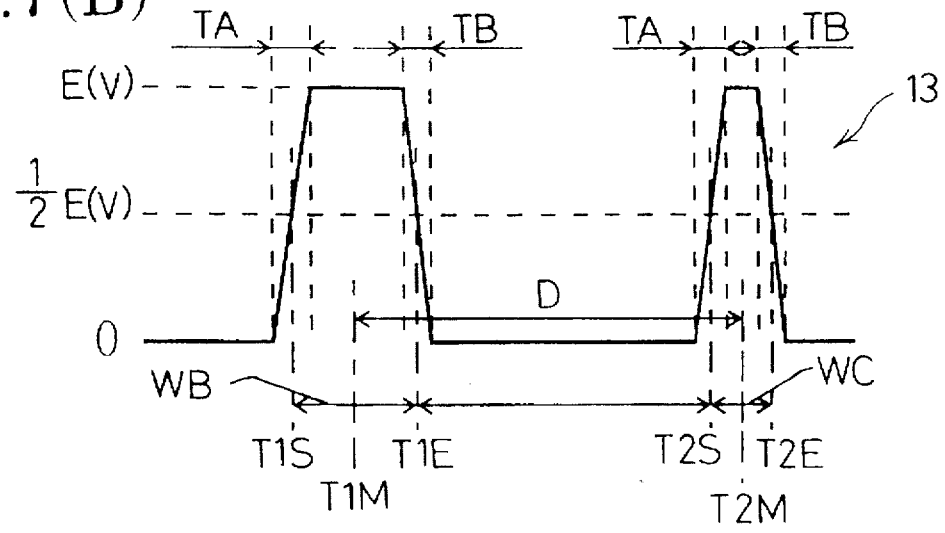

Turning to FIG. 6 and FIGS. 7A and 7B, one embodiment of the control circuit which implements the drive waveforms 10, 20A, 20B, 20C, and 20D will be described.

The ink-jet apparatus of the present embodiment has the same construction as the conventional ink-jet apparatus 600 as shown in FIGS. 1 and 2. One embodiment of the configuration of the new control circuit 125 that implements the drive waveforms 10, 20A, 20B, 20C, and 20D will be described referring to FIG. 6.

The control circuit 125 shown in FIG. 6 is made up of a charging circuit 182 for ejecting purposes, a discharging circuit 184, and a pulse control circuit 186.

Input terminals 181 and 183 are used for inputting a pulse signal to set voltages applied to the electrode 619 in the ink flow passage 613 to E (V) and 0 (V).

The charging circuit 182 comprises resistors R101, R102, R103, R104, and R105 and transistors TR101 and TR102.

When the input terminal 181 receives an ON signal (+5 V), the transistor TR101 is turned on via the resistor R101. An electrical current flows from a positive power supply 187 via the resistor R103 in the direction from a collector to an emitter of the transistor TR101. Accordingly, a voltage applied to potential divider constituted by the resistors R104 and R105 connected to the positive power supply 187 increases, and the electrical current flowing to the base of the transistor TR102 increases, whereby the emitter and collector of the transistor TR102 are electrically connected together. A voltage of 22 (V), for example, is applied from the positive power supply 187 to a terminal 191A of the output terminal 191 via the collector and emitter of the transistor TR102 and the resistor R120. The voltage is applied from the power supply 187 to the terminal 191A at timings T1 and T3 shown in FIG. 7A. The timing charts shown in FIGS. 7A and 7B show signals received by the input terminals 181 and 182 of the control circuit 125 and a signal appearing at the output terminal 191, respectively.

The discharging circuit 184 will now be described. The discharging circuit 184 is made up of the resistors R106 and R107, and the transistor TR103. When the input terminal 183 receives an ON signal (+5 V), a TR103 is turned on via the resistor R106. The terminal 191A of the output terminal 191 connected to a resistor R120 is grounded via the resistor R120. Electrical charges applied to the actuator wall 603 of the ink flow passage 613 shown in FIGS. 1 and 2 are discharged. The electrical charges are discharged at timings T2 and T4 shown in FIG. 7A.

An input signal 11 having a second drive waveform received by the input terminal 181 of the charging circuit 182 is usually in an OFF state as it is illustrated in the timing chart of FIG. 7A. The input signal 11 is turned on at predetermined timing T1 to eject ink, and it is turned off at timing T2. Subsequently, the input signal 11 is turned on at timing T3 and is turned off at timing T4.

A signal 12 received by an input terminal 183 of the discharging circuit 184 is turned off when the input signal 11 is in an ON state (at timings T1 and T3), as shown in the timing chart of FIG. 7B. The signal 12 is turned on when the input signal 11 is in an OFF state (at timings T2 and T4).

An output waveform 13 appearing at the electrode 191A of the output terminal 191 is usually maintained at 0 (V). The actuator wall 603 that is connected to the output terminal 191 and is made of a shear mode piezoelectric element is charged with electrical charges at timing T1. After the lapse of a charging time TA which is determined by the transistor TR102, the resistor R120, and the capacitance of the actuator wall 603 made of the shear mode piezoelectric element, the output waveform 13 becomes a voltage E (V) (e.g., 22 (V)). The electrical charges of the actuator wall 603 made of the shear mode piezoelectric element are discharged at timing T2. After the lapse of a discharging time TB which is determined by the transistor TR103, the resistor R120, and the capacitance of the actuator wall 603 made of the shear mode piezoelectric element, the output waveform 13 becomes 0 (V). The actuator wall 603 made of the shear mode piezoelectric element is charged with electrical charges at timing T3. After the lapse of the charging time TA which is determined by the transistor TR102, the resistor R120, and the capacitance of the actuator wall 603 made of the shear mode piezoelectric element, the output waveform 13 becomes the voltage E (V) (e.g., 22 (V)). The electrical charges of the actuator wall 603 made of the shear mode piezoelectric element are discharged at timing T4. After the lapse of the discharging time TB which is determined by the transistor TR103, the resistor R120, and the capacitance of the actuator wall 603 made of the shear mode piezoelectric element, the output waveform 13 becomes 0 (V).

In practice, delays TA and TB develop at the leading and falling edges of the drive waveform 13, and therefore the timings T1, T2, T3, and T4 are respectively set in such a way that the pulse widths WB and WC of the second pulse signals B and C of the drive waveforms 20A to 20D and the delay time D at a voltage of ½ E (V) (e.g., 11 (V)) become identical with the values shown in FIG. 5 and in the above descriptions.

With reference to FIG. 5 and FIGS. 7A and 7B, the drive waveform 10 will be described. In the case of the drive waveform 10, an input signal is usually in an OFF state, and the signal is then turned on at the predetermined timing T1 at which time the ink is ejected, as shown in FIGS. 7A and 7B. The signal is then turned off at the timing T2, and it is usually left in an OFF state at the timings T3 and T4. The timings T1 and T2 are set in such a way that the pulse width WA of the first pulse signal A of the drive waveform 10 shown in FIG. 5 is identical with the values as described above.

Subsequently, a pulse control circuit 186 for generating a pulse signal, which has the timings T1, T2, T3, and T4 and is received by the input terminal 181 of the charging circuit 182 and the input terminal 183 of the discharging circuit 184, will now be described.

Figure 8:
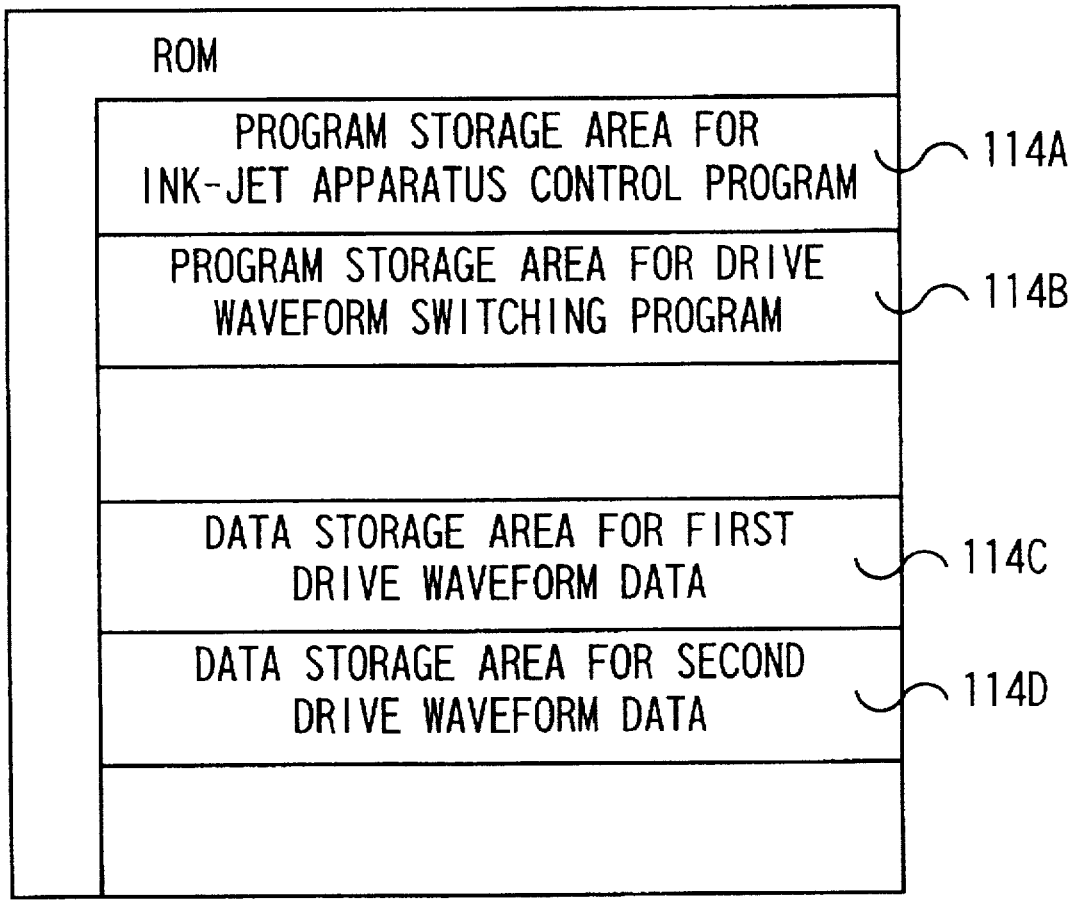
FIG. 8 is a schematic view showing a memory region in ROM of the control circuit according to an embodiment of the invention.

The pulse control circuit 186 is provided with a CPU 110 for executing a variety of calculations. The CPU 110 is connected to RAM 112 which stores print data and a variety of other data, and ROM 114 which stores a control program of the pulse control circuit 186 and sequence data used for generating turn-on and turn-off signals at the timings T1, T2, T3, and T4. As shown in FIG. 8, the ROM 114 has a program storage area 114A for controlling an ink-jet apparatus, a storage area 114B for holding a drive waveform switching program, a storage area 114C for holding first drive waveform data, and a storage area 114D for holding second drive waveform data. Hence, the sequence data of the drive waveform 10 are stored in the first drive waveform data storage area 114C. Sequence data of each of the second drive waveforms 20A to 20D are stored in the second drive waveform data storage area 114D.

The CPU 110 is connected to an I/O bus 116, through which a variety of data items are input and output. The I/O bus 116 is connected to a print data receiving circuit 118 and pulse generators 120 and 122. An output of the pulse generator 120 is connected to the input terminal 181 of the charging circuit 182, and an output of the pulse generator 122 is connected to the input terminal 183 of the discharging circuit 184.

The CPU 110 controls the pulse generators 120 and 122 in accordance with the sequence data stored in the first pulse drive waveform data storage area 114C and the second pulse drive waveform data storage area 114D. As a result of previously having stored various patterns of the timings T1, T2, T3, and T4 in the first drive waveform data storage area 114C and the second drive waveform data storage area 114D in the ROM 114, a drive pulse such as the first drive waveform 10 and the second drive waveforms 20A to 20D as shown in FIG. 5 can be applied to the actuator wall 603 made of the shear mode type piezoelectric element. Therefore, it becomes possible to implement the operation and effect of the invention.

The pulse generators 120 and 122, the charging circuit 182, and the discharging circuit 184 are provided in a number corresponding to the number of ink jet nozzles. In the present embodiment, the control of one nozzle has been described as one representative example. The same description is applicable to the control of other nozzles.

Figure 9:
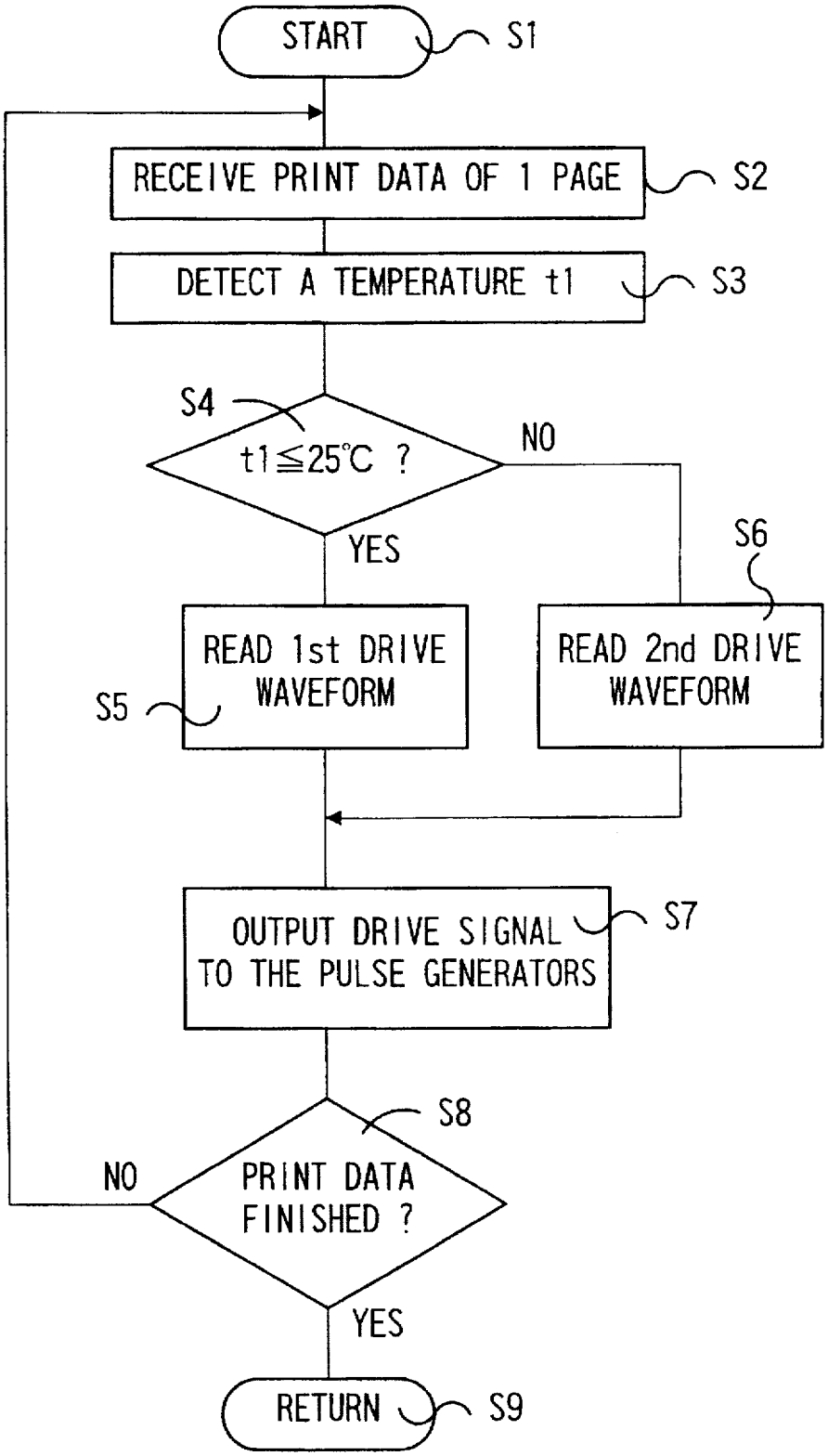
FIG. 9 is a flowchart showing a program of switching drive waveforms according to an embodiment of the invention.

With reference to FIGS. 6 and 9, equipment and a control method used for switching between the first drive waveform 10 and the second drive waveforms 20A to 20D will now be described.

In the pulse control circuit 186, a temperature detecting circuit 124 is connected to the I/O bus 116. The temperature detecting circuit 124 is connected to a temperature sensor 126 for detecting an ambient temperature, a changeover switch 127 which is manually set so as to select either the first drive waveform 10 or the second drive waveforms 20A to 20D, and a mode switch 128 for switching between automatic switching mode which uses the temperature sensor 126 and manual switching mode which uses the changeover switch 127. Although the temperature sensor 126 is designed so as to measure the ambient temperature of the pulse control circuit 186, it may be designed so as to directly measure the temperature of an ink jet head.

Referring to the flowchart show in FIG. 9, the automatic switching mode will be described. The flowchart shown in FIG. 9 is stored in the drive waveform switching program storage area 114B of the ROM 114, and this program is executed by the CPU 110.

The ink-jet apparatus is controlled as a result of an ink-jet apparatus control program for controlling the overall ink-jet apparatus stored in the ink-jet apparatus control program storage area 114A of the ROM 114 being executed by the CPU 110. When the CPU 110 receives print data from a print data receiving circuit 118 via the I/O bus 116 (steps S1 and S2 shown in FIG. 9), the CPU 110 detects a temperature t1 obtained by the temperature sensor 126 of the temperature detecting circuit 124 via the I/O bus 116 (step S3). If the detected temperature t1 is 25° C. or less (step S4: YES), the first drive waveform data are read (step S5). On the other hand, if the detected temperature t1 is in excess of 25° C. (step S4: NO), the second drive waveform data are read (step S6).

In accordance with the read drive waveform data, a drive signal is output to the pulse generators 120 and 122 (step S7). These operations are repeatedly carried out while the print data are received. When the receiving of the print data is finished (step S8: YES), the processing returns to the initial step by the ink-jet apparatus control program for controlling the overall ink-jet apparatus.

If the apparatus is already in the manual switching mode as a result of the switching action of the switch 128, the CPU 110 selects either the first drive waveform 10 or one of the second drive waveforms 20A to 20D in accordance with the setting of the changeover switch 127.

Results of an ink ejecting test obtained when the ink-jet apparatus was driven by the ink-jet apparatus driving method of the present embodiment will now be described.

Figure 10:
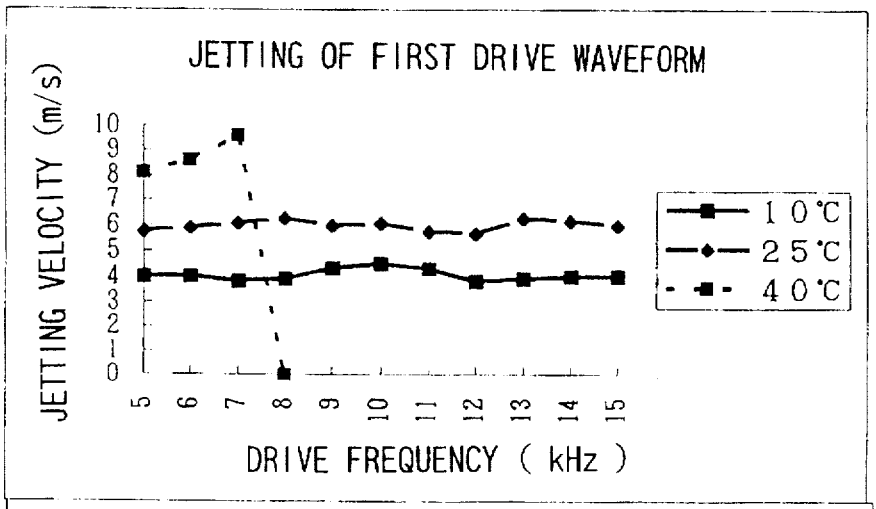
FIGS. 10A and 10B are plots showing results of a test in which the temperature and frequencies used in the ink-jet apparatus and the driving method thereof were changed.
Figure 10:
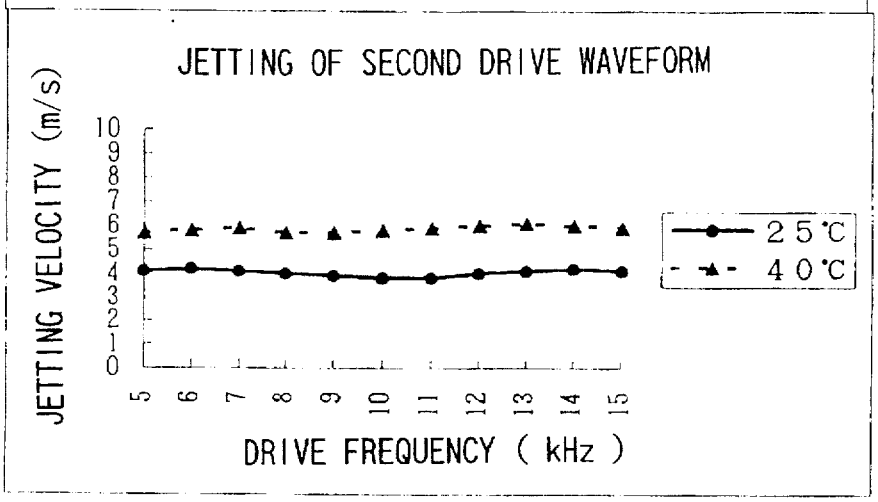

The ink-jet apparatus was driven at a voltage of 22 with a very slow drive frequency of, e.g., 60 Hz, so that ink is ejected at a velocity of 4 m/s at a temperature of 10° C. by means of the first drive waveform 10. The drive frequency was changed from 5 kHz to 15 kHz at ambient temperatures of 10°, 25°, and 40° C. FIG. 10A shows results of the ejecting test using the first drive waveform 10, and FIG. 10B shows results of the ejecting test using the second drive waveform 20.

When the apparatus was driven using the first drive waveform 10, the ink could be stably ejected at a velocity of about 4 m/s at a temperature of 10° C. irrespective of the drive frequency. Further, the ink could be stably ejected at a velocity of about 6 m/s at a temperature of 25° C. irrespective of the drive frequency. However, it was impossible for the ink-jet apparatus to eject the ink at a temperature of 40° C. at a frequency of 8 kHz or more using the first drive waveform. Contrary to this, when the ink-jet apparatus was driven using the one of the second drive waveforms 20A–20D at the same voltage of 22 V as it was driven using the first drive waveform, it was impossible to eject the ink at a temperature of 10° C. but it was possible to stably eject the ink at a velocity of about 4 m/s at a temperature of 25° C. irrespective of the drive frequency as well as to stably eject the ink at a velocity of about 6 m/s at a temperature of 40° C. irrespective of the drive frequency.

Therefore, it can be seen that the ink can be stably ejected at substantially the same velocity irrespective of the drive frequency at any temperature from low to high temperatures so long as the ink-jet apparatus is driven using the first drive waveform 10 in the case of an ambient temperature of 25° C. or less and is driven using any one of the second drive waveforms 20A to 20D in the case of an ambient temperature of more than 25° C.

According to the ink-jet apparatus and the driving method thereof of the invention, the first pulse signal A of the first drive waveform 10 and the second pulse signal B and the third pulse signal C of the second drive waveforms 20A to 20D, which are a positive voltage, are applied to the electrode 619 of the ink flow passage 613. Therefore, the ink-jet apparatus requires only the positive power supply 187. When compared with a conventional ink-jet apparatus which uses a voltage variable circuit or two or more types of power supply, each having a different voltage, the control circuit becomes simpler, and hence the cost of the ink-jet apparatus can be reduced.

Results of the test conducted in order to obtain the pulse width WB of the second pulse signal B of the second drive waveform 20, the pulse width WC of the third pulse signal C, and an appropriate range of the delay time D from the center time T1M to the center time T2M will now be described.

As a result of the pulse width WB of the second pulse signal B of the second drive waveform being changed with respect to the uni-directional propagation time 1 T of the pressure wave within the ink flow passage 613, the pressure within the ink flow passage 613 obtained at the time of ejecting the ink drops, and the ink was ejected at a slower speed. However, when the pulse width WB of the second pulse signal B was in the range between 0.4 T or less and 1.7 T or more, it became impossible to eject the ink. It turned out that it was necessary to set the pulse width WB of the second pulse signal B between 0.5 to 0.9 times or 1.1 to 1.6 times the uni-directional propagation time T.

FIG. 11 shows results of an evaluation test obtained when the pulse width WC of the third pulse signal C and the time delay D from the center time T1M to the center time T2M were respectively changed to 0.3 T to 2.0 T and 2.5 T to 3.5 T. Changes in the ink jet velocity were examined while the drive frequency was changed between 5 kHz and 15 kHz at an ambient temperature of 40° C. At this time, the drive voltage was 22 (V).

A double circle in the evaluation results designates a change in the ink-jet velocity under 1 m/s, a circle designates a change in the ink-jet velocity 1.0 to under 2.0 m/s, a triangle designates a change in the ink-jet velocity 2.0 to under 3 m/s, and "x" designates that the ink could not be ejected at a certain frequency. From these results, on the assumption that the delay time D is in the range of 2.75 to 3.25 and the pulse width WC of the third pulse signal C is in the range of 0.3 to 0.7 T or 1.3 to 1.7 T, the ink is ejected in such a way that superior print quality is obtained. Further, on the assumption that the delay time D is 3.0 T and the pulse width WC of the third pulse signal C is 0.5 T or 1.3 to 1.7 T, the ink can be ejected in such a way that superior print quality is obtained while variations in the ink jet velocity are reduced to a lesser extent.

Figure 3:
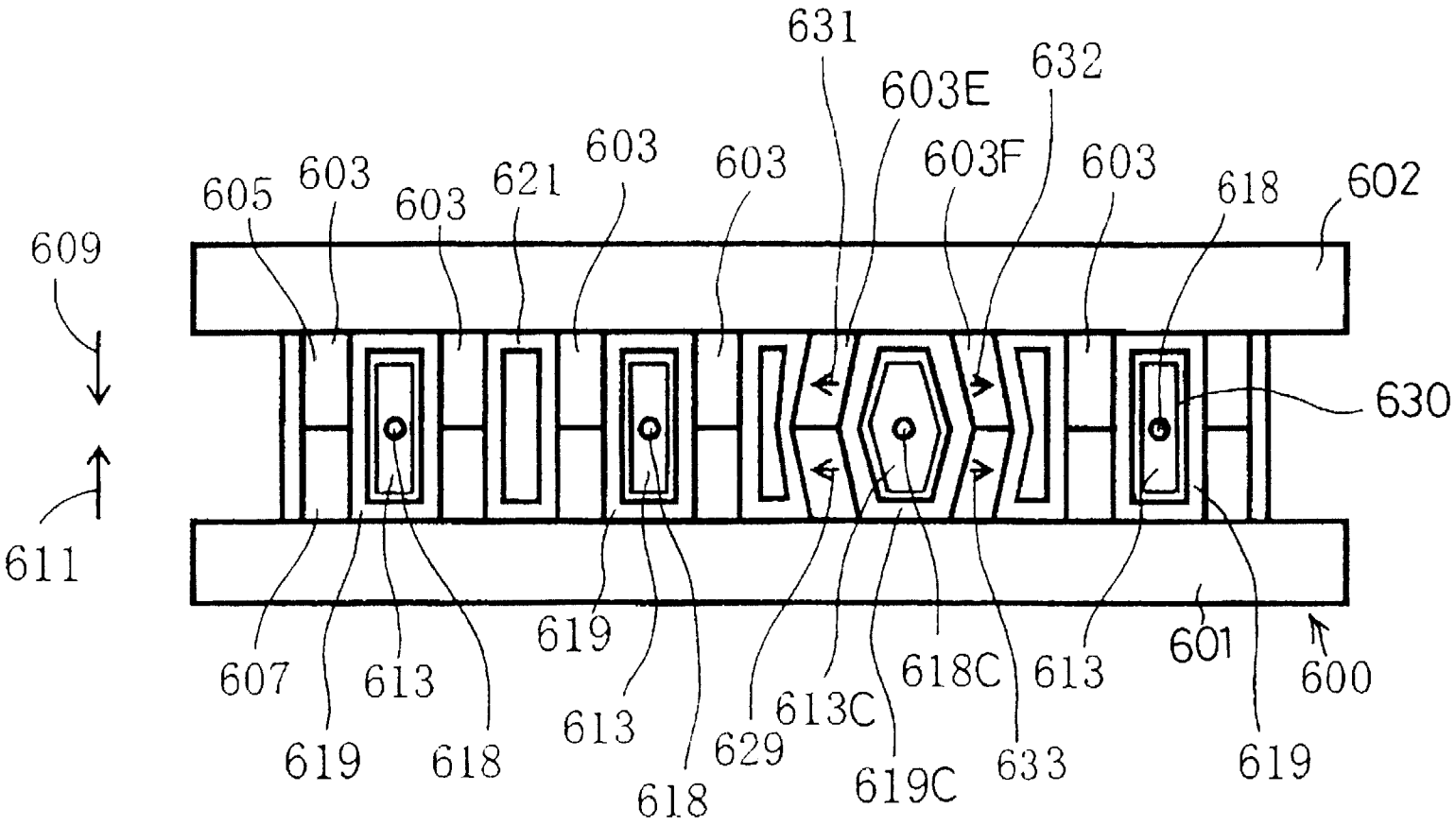
Fig.3 RELATED ART
FIG. 3 is front view showing how the conventional ink-jet apparatus operates.

Although one embodiment of the ink-jet apparatus and the driving method thereof according to the invention have been described in detail, the invention is not limited to this embodiment. For example, if the directions of polarization of the upper and lower walls designated by the arrows 609 and 611 shown in FIG. 3 are reversed, a negative power supply may be employed instead of the positive power supply 187.

Figure 12:
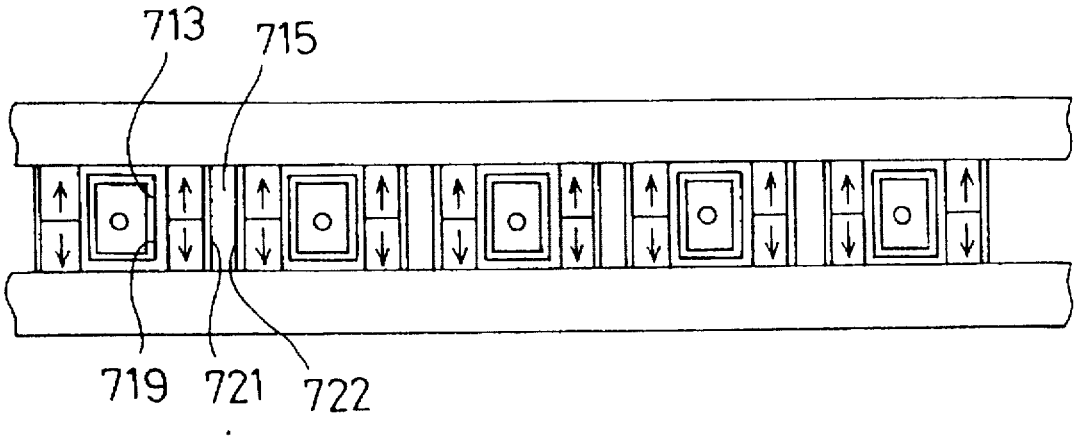
FIG. 12 is a front view showing the construction of an ink-jet apparatus according to another embodiment of the invention.

Moreover, as shown in FIG. 12, provided that the directions of the polarization of the upper and lower walls are reversed, that the electrode 719 provided in the ink flow passage 713 is grounded, and that the electrode provided in the space 715 is divided into two electrodes 721 and 722, it may be possible to connect the electrode 721 to the terminal 191A of the output terminal 191 connected to the resistor R120, and connect the other electrode 722 to a terminal of an output terminal connected to another resistor of another charging circuit (which is not shown in the drawings).

In the above-described embodiment, the ink was ejected as a result of variations in the volume of the ink flow passage 603 caused by piezoelectric deformation of the lower and upper walls 607 and 605 of the actuator wall 603. It may be possible to eject the ink by forming either the upper or lower wall from material which does not undergo piezoelectric deformation in such a way as to be deformed in association with the piezoelectric deformation of the remaining wall.

Although the air chambers 615 are provided on both sides of the ink flow passage 603 in the present embodiment, the ink flow passages may be disposed side by side without the air chambers.

Still further, although the first drive waveform 10 is used for driving the ink-jet apparatus when the ambient temperature is 25° C. or less, it was also confirmed that the ink had been stably ejected even by use of a drive waveform in which a pulse signal equal to the third pulse signal C of the second drive waveform is applied after the application of the first pulse signal A of the first drive waveform 10.

It should be noted that other modifications or improved embodiments of this embodiment are obvious for those skilled in the art.

What is claimed is:

1. A method of driving an ink-jet apparatus including an ink chamber filled with ink, an actuator for changing a volume of said ink chamber, and a control unit which causes a pressure wave to develop in said ink chamber by applying a first pulse signal to said actuator so as to increase the volume of said ink chamber, and causes the volume of said ink chamber to be decreased from the increased state to the original state after the lapse of a time T during which the pressure wave uni-directionally travels along the inside of said ink chamber, so that the ink in said ink chamber is pressurized and eventually ejected, the method comprising:

causing the ink to be ejected from the ink chamber by applying said first pulse signal from said control unit to said actuator if an ambient temperature is at a predetermined temperature or less; and causing the ink to be ejected from the ink chamber by applying a second pulse signal, which has a different pulse width but a same peak value compared with said first pulse signal from said control unit to said actuator if the ambient temperature is in excess of the ambient temperature, and thereafter applying a third pulse signal, which has a pulse width 0.3 to 0.7 times or 1.3 to 1.7 times the uni-directional propagation time T and has the same peak value as said second pulse signal, to said actuator, the third pulse signal having a center time T2M between a time T2S at which the third pulse signal rises and a time T2E at which the third pulse signal falls being delayed by 2.75 to 3.25 times the uni-directional propagation time T with regard to center time T1M between a time T1S at which the second pulse signal rises and a time T1E at which the second pulse signal falls.

2. A method of driving an ink-jet apparatus as defined in claim 1, wherein the pulse width of said third pulse signal is 0.5 or 1.3 to 1.7 times said uni-directional propagation time T, and said center time T2M of the third pulse signal is delayed by 3.0 times the uni-directional propagation time T with respect to the center time T1M of the second pulse signal.

3. A method of driving an ink-jet apparatus as defined in claim 1, wherein the pulse width of said second pulse signal is 0.5 to 0.9 times or 1.1 to 1.6 times said uni-directional propagation time T.

4. A method of driving an ink-jet apparatus as defined in claim 1, further comprising:

detecting a temperature with a temperature sensor; and applying said first pulse signal to said actuator from said control unit causing the ink to be ejected if the temperature detected by said temperature sensor is at a predetermined temperature or less, and applying said second pulse signal, which has a different pulse width but the same peak value compared with said first pulse signal, to said actuator causing the ink to be ejected, and thereafter applying said third pulse signal, which has the same peak value as said second pulse signal, to said actuator if the detected temperature is in excess of the predetermined temperature.

5. A method of driving an ink-jet apparatus as defined in claim 1, wherein a changeover switch selects a pulse waveform from a waveform of said first pulse signal, a waveform of said second pulse signal, and a waveform of said third pulse signal.

6. A method of driving an ink-jet apparatus as defined in claim 1, further comprising selecting between an automatic switching mode and a manual switching mode with a mode selector.

7. A method of driving an ink-jet apparatus as defined in claim 4, further comprising selecting between an automatic switching mode and a manual switching mode with a mode selector.

8. A method of driving an ink-jet apparatus as defined in claim 5, further comprising selecting between an automatic switching mode and a manual switching mode with a mode selector.

9. A method of driving an ink-jet apparatus as defined in claim 3, wherein said actuator acts as at least part of walls forming said ink chamber, and said walls are at least partly made of a piezoelectric material.

10. An ink-jet apparatus comprising:

an ink chamber filled with ink;

an actuator for changing a volume of said ink chamber; and a control unit which causes a pressure wave to develop in said ink chamber by applying a first pulse signal to said actuator so as to increase the volume of said ink chamber, and causes the volume of said ink chamber to be decreased from the increased state to the original state after a lapse of time T during which the pressure wave uni-directionally travels along the inside of said ink chamber, so that the ink in said ink chamber is pressurized and eventually ejected, wherein if an ambient temperature is at a predetermined temperature or less, said control unit causes the ink to be ejected by applying said first pulse signal to said actuator, and if the ambient temperature is in excess of the predetermined temperature, said control unit applies a second pulse signal, which has a different pulse width but a same peak value compared with said first pulse signal, to said actuator so as to cause the ink to be ejected, and thereafter applies a third pulse signal, which has a pulse width 0.3 to 0.7 times or 1.3 to 1.7 times the uni-directional propagation time T and has the same peak value as said second pulse signal, to said actuator, the third pulse signal having a center time T2M between a time T2S at which the third pulse signal rises and a time T2E at which the third pulse signal falls being delayed by 2.75 to 3.25 times the uni-directional propagation time T with regard to a center time T1M between time T1S at which the second pulse signal rises and a time T1E at which the second pulse signal falls.

11. An ink-jet apparatus as defined in claim 10, wherein the pulse width of said second pulse signal is 0.5 to 0.9 times or 1.1 to 1.6 times said uni-directional propagation time T.

12. An ink-jet apparatus as defined in claim 10, wherein, the pulse width of said third pulse signal is 0.5 or 1.3 to 1.7 times said uni-directional propagation time T, and the center time T2M of the third pulse signal is delayed by 3.0 times the uni-directional propagation time T with respect to the center time T1M of the second pulse signal.

13. An ink-jet apparatus as defined in claim 12, wherein the pulse width of said second pulse signal is 0.5 to 0.9 times or 1.1 to 1.6 times said uni-directional propagation time T.

14. An ink-jet apparatus as defined in claim 10, further comprising a temperature sensor for detecting the ambient temperature.

15. An ink-jet apparatus as defined in claim 10, further comprising a changeover switch for selecting a pulse waveform from a waveform of said first pulse signal, a waveform of said second pulse signal, and a waveform of said third pulse signal.

16. An ink-jet apparatus as defined in claim 10, further comprising a mode selector for switching between an automatic switching mode and a manual switching mode.

17. An ink-jet apparatus as defined in claim 14, further comprising a mode selector for switching between an automatic switching mode and a manual switching mode.

18. An ink-jet apparatus as defined in claim 15, further comprising a mode selector for switching between an automatic switching mode and a manual switching mode.

19. An ink-jet apparatus as defined in claim 18, wherein said actuator acts as at least part of walls forming said ink chamber, and said walls are at least partly made of a piezoelectric material.

20. An ink-jet apparatus as defined in claim 19, wherein said control unit comprises:

a pulse control circuit including a CPU, a RAM connected to the CPU and storing print data, a ROM connected to the CPU and storing control programs, a temperature detecting circuit connected between the temperature sensor and the CPU for selecting among a plurality of drive waveforms based on the detected temperature, a mode switch connected to the temperature detecting circuit for placing the pulse control circuit in a manual switching mode or an automatic switching mode, a changeover switch for manually selecting between one of the plurality of drive waveforms when in the manual switching mode, a print data receiving circuit connected to the CPU for receiving print data, and at least one pulse generator circuit connected to the CPU for generating pulse signals based on the drive waveforms;

a charging circuit connected between the at least one pulse control circuit and an electrode connected to said side walls for applying a charge to said electrode; and a discharging circuit connected between said at least one pulse control circuit and said electrode for discharging the charge signal.

* * * * *